United States Patent [19]

Sisson et al.

[11] Patent Number: 4,467,963

[45] Date of Patent: Aug. 28, 1984

[54] SINGLE DUMP SINGLE SOLENOID FUEL INJECTOR

[75] Inventors: Albert E. Sisson; Edward J. Hayes, both of Farmington Hills, Mich.

[73] Assignee: The Bendix Corporation

[21] Appl. No.: 572,975

[22] Filed: Jan. 24, 1984

Related U.S. Application Data

[63] Continuation of Ser. No. 364,816, Apr. 2, 1982, abandoned.

[51] Int. Cl.[3] ..... F02M 47/02

[52] U.S. Cl. ..... 239/90; 239/91; 239/95

[58] Field of Search ..... 239/80, 90, 91, 92, 239/93, 94, 95, 125, 585

[56] References Cited

U.S. PATENT DOCUMENTS 2,279,010 4/1942 Nichols ..... 239/93 X 2,378,165 6/1945 Waeber ..... 239/93 X 4,235,374 11/1980 Walter et al. ..... 239/90

4,281,792 8/1981 Sisson et al. ..... 239/90 X

*Primary Examiner*—Andres Kashnikow

*Assistant Examiner*—Mary F. McCarthy

*Attorney, Agent, or Firm*—Markell Seitzman; Russel C. Wells

[57] ABSTRACT

A unit injector having a mechanically driven piston and a remotely situated metering piston situated in a bore. The interplunger volume defining a timing chamber and the volume below the metering piston defining a metering chamber. The injector further including a single electrically responsive valve for controlling the functions of injection timing and fuel metering and a single dump port fabricated in the walls of the bore for relieving the fuel pressure on the timing chamber which correspondingly permits the pressure of fuel in the metering chamber to be decreased.

7 Claims, 4 Drawing Figures

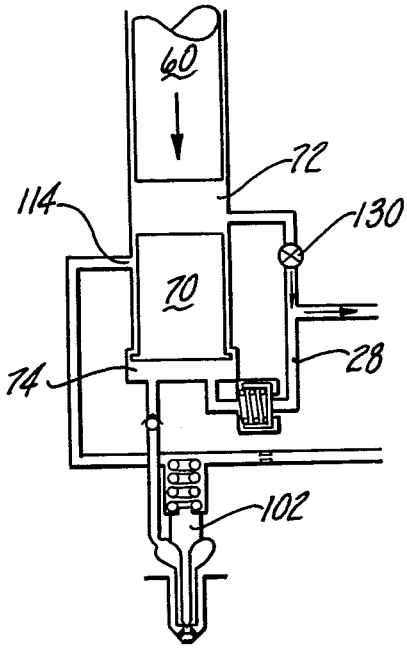
Fig-2
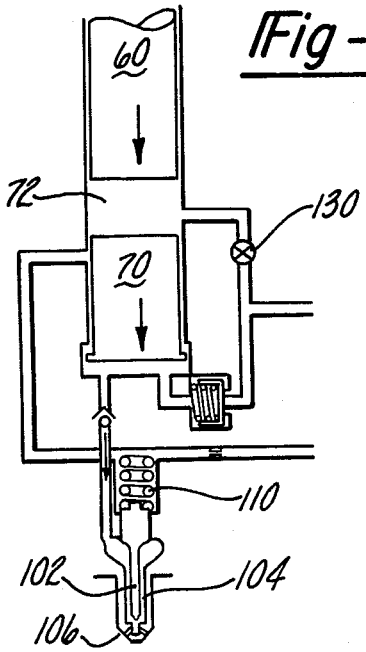
Fig-3
Fig-4
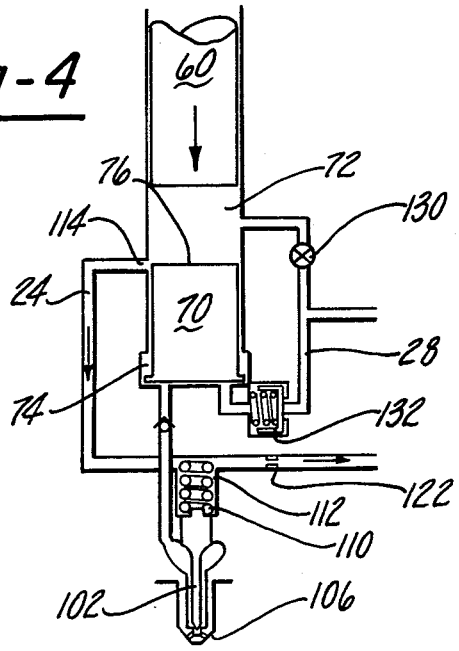

SINGLE DUMP SINGLE SOLENOID FUEL INJECTOR

CROSS REFERENCE TO RELATED APPLICATIONS

This application is a continuation of application Ser. No. 364,816 filed Apr. 2, 1982, now abandoned.

This Application is related to the co-pending Application Ser. No. 282,629 filed July 13, 1981, now U.S. Pat. No. 4,427,152 which is commonly assigned.

BACKGROUND AND SUMMARY OF THE INVENTION

The instant Application relates generally to fuel injection systems and more particularly to mechanically or electrically operated diesel fuel injectors having means for separately regulating each of the functions of timing of fuel injection and metering of fuel into the injector thereby permitting separate and independent adjustment to both the timing of fuel injection into an engine and the quantity of fuel metered into the fuel injector prior to injection. U.S. Pat. Nos. 4,235,374 to Walter et al which issued Nov. 25, 1978 and 4,281,792 to Sisson et al which issued Aug. 4, 1971 disclose a single solenoid fuel injector. This fuel injector injects metered quantities of fuel into the cylinders of a diesel engine as well as to function as an engine driven pump to pressurize the fuel prior to injection into the engine. The above noted United States patents disclose a fuel injector which utilizes a primary pumping piston disposed to be actuated by a cam operated mechanism, a metering or floating piston slidably mounted within the interior of the injector and a nozzle portion contiguous with fuel injector or combustion chamber of the engine. A timing chamber is formed between the primary pumping piston and the metering piston. The injector includes a cooperating electronic control unit (ECU) which generates a signal to control the state of a single electronically controlled solenoid which when in an open condition permits fuel to flow into the timing chamber and which when closed initiates fuel injection. In addition to the formation of the timing chamber between the pumping piston and the metering piston, a metering chamber is formed between the lower portion of the metering piston and the bore which houses the floating piston. The quantity of fuel fed to the metering chamber determines the amount of fuel which thereafter will be injected into each engine cylinder. The control valve is utilized to control both the timing of injection and the quantity of fuel metered to the engine. In the above patents, a substantially unobstructed fuel passage is provided from a supply to the metering chamber. Consequently, the amount of fuel that resides within the metering chamber is determined by the volume of the metering chamber, hence, this method of metering has been called volumetric fuel metering. During the metering mode of operation of the Walter et al or the Sisson et al injectors, the pumping piston is caused to retract allowing the supply pressure in the metering chamber to force the metering piston upward to follow the pumping piston retraction. This causes the volume of the metering chamber to be increased. To terminate the metering process the control valve is opened allowing supply fuel to flow into the timing chamber, thereby breaking the hydraulic link between the two pistons. A spring is inserted within the timing chamber to bias the two pistons apart to insure that the motion of the metering piston is stopped and that no more fuel enters the metering chamber. The utilization of the spring within the metering piston increases the length of the injector therein consuming valuable engine space. It should be recalled that a unit injector is typically incorporated within the engine and driven by the cam shaft of the engine.

The above noted fuel injectors are relatively complex in that they utilize check valves within the movable metering piston, in particular, a timing chamber check valve and a metering chamber check valve which are included within the movable floating or metering piston. The incorporation of the check valves within the moving element complicates the manufacture and assembly of the above noted fuel injectors and may cause non-repeatability in the injector performance. During the dumping mode of operation of these fuel injectors, fuel is dumped from the timing chamber to drain through the timing chamber check valve. By dumping the timing chamber through the restriction imposed by the check valve slows the dumping process.

It is therefore an object of the present invention to provide a unit injector having a less massive metering piston to permit a more rapid initiation of the injection mode of operation. In addition, it is an object of the present invention to provide a unit injector having a shorter metering piston thus providing a more compact design. A further object of the present invention is to eliminate the check valves from the influence of the movable metering piston and to eliminate the necessity for the timing chamber check valve and biasing spring. Another object of the invention is to provide a unit injector having one dump port and to hydraulically bias the needle valve, with the dumped fuel to rapidly terminate injection.

Accordingly, the invention comprises: a fuel injector comprising: a body having an axially extending bore, a pumping piston and a remotely positioned metering piston positioned within the bore. A timing chamber is defined within the bore between the pumping piston and the metering piston and a metering chamber defined between the metering piston and the lower portion of the bore. The injector includes first fuel passage having an electronically controlled valve situated therein for receiving pressurized fuel and for controllably transmitting the fuel to the timing chamber; a second fuel passage having a pressure regulator for receiving pressurized fuel for establishing the pressure level for fuel in the metering chamber and for transporting the received fuel to the metering chamber. The injector further includes a spring chamber and nozzle situated remotely from the metering chamber wherein the nozzle partially extends within the spring chamber. A biasing spring is located within the spring chamber for biasing the nozzle in a closed position during non-injecting modes of operation. The injector further includes a third fuel passage terminating at an open end at the wall of the bore, proximate said timing chamber forming in cooperation with the bore, a timing chamber dump port. The third fuel passage also communicates with the spring chamber and with a fourth passage having a restrictive orifice situated therein for establishing upstream thereto an increased pressure during the period of time that fuel in the timing chamber is being dumped through.

BRIEF DESCRIPTION OF THE DRAWINGS

In The Drawings

FIGS. 2-4 illustrate various modes of operation of the fuel injector of FIG. 1.

DESCRIPTION OF THE PREFERRED EMBODIMENT OF THE INVENTION

Figure 1:
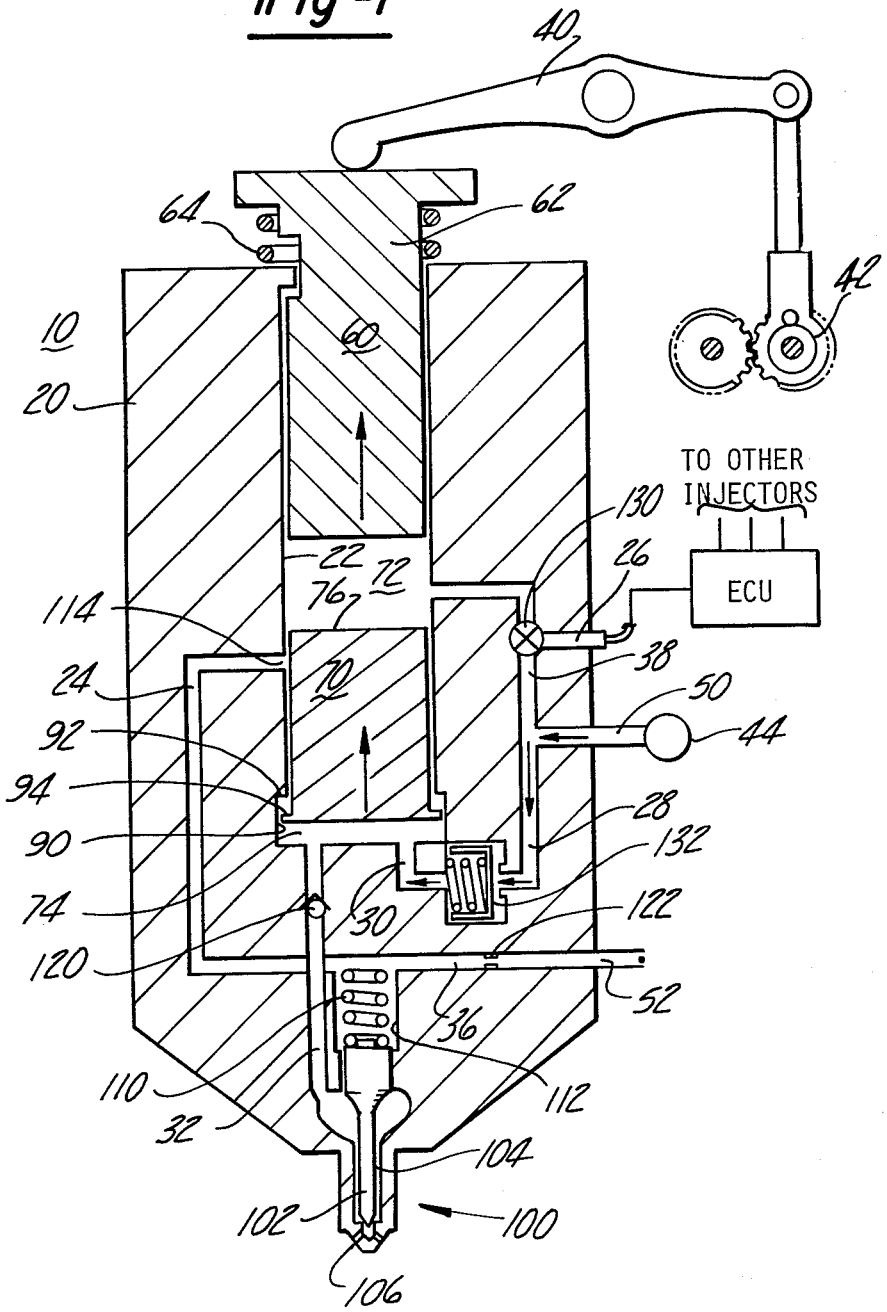
FIG. 1 is a schematic diagram of a diesel engine fuel injector.

Turning now to the drawings, FIG. 1 schematically depicts the major components of a diesel unit injector 10 and further shows the injector 10 in its metering mode of operation. The injector includes a housing 20 having a central bore 22 and further includes a plurality of fuel carrying passages 24, 26, 28, 30, 32, 36, 38. Fuel is received by the injector 10 through a supply port 50 and returned through a drain port 52 to a low pressure reservoir such as a fuel tank which is exposed to atmosphere pressure. The injector 10 further includes a pumping piston 60 that may be formed as an integral part of a follower 62 which is biased upwardly by a heavy duty spring 64. The follower 62 and pumping piston 60 may be formed as separate or integral elements. The follower is urged downwardly by a rocker arm 40 driven by a cam 42. The relationship of the rocker arm 40 to the engine is more particularly defined in U.S. Pat. No. 4,281,792 which is expressly incorporated herein by reference. The central bore 22 also receives a metering piston 70. The volume between the pumping piston 60 and the metering piston 70 forms a timing chamber 72. The volume above the bottom of the central bore 22 and below the metering piston 70 form a metering chamber 74.

In order to prevent the metering piston 70 from moving too far upward within the central bore 22. The injector 10 further includes a mechanical means for prohibiting excessive metering piston travel. In the embodiment of the invention shown in FIG. 1 this excess travel means is accomplished by having the lower end of the bore 22 include an enlarged diameter bore 90. The transition between the bore 90 and the upper portion of the bore 22 form a shoulder 92. In addition, the metering piston 70 further includes an outwardly extending shoulder 94 which will physically contact the shoulder 92 after a determinable amount of upward travel of the metering piston 70. Other means for accomplishing this mechanical stop can be accomplished by utilizing pins and cooperating slots manufactured within the housing 20 and or metering piston 70.

The injector 10 further includes a nozzle 100 situated remotely from the metering chamber 74. The nozzle 100 includes a needle valve 102 of a known variety which is loosely received within a passage 104. The nozzle 100 further includes a plurality of flow orifices 106. A spring 110 is situated above the needle valve for biasing the needle valve 102 during non-injecting periods to prevent fuel from exiting from the flow orifices 106. The spring 110 is situated withing a spring chamber or bore 112. The bore 112 is connected to one of the passages within the injector; more particularly, passage 24 termintes at an end at the bore 112. Passage 24 terminates at its other end in the walls of the central bore 22 thus forming a timing chamber dump port 114. Fuel is communicated from the metering chamber 74 to the passage 104 surrounding the needle valve 102 through the passage 32 which may optionally include a blow back check valve 120. The purpose of the check valve 120 is to prohibit the transmission of fumes within the combustion chamber of the engine from propagating back into the injector. The bore 112 which houses the spring 110 is connected to the drain port 52 of the injector 10 through a passage 36 having an orifice 122 situated therein.

Fuel is communicated from an external pump 44 to the supply port 50 and thereafter distributed through passage 38, which contains a solenoid control valve 130, to the timing chamber 72. Additionally, fuel is supplied to the metering chamber 74 through the passage 28 which includes a fill pressure regulator 132.

Reference is made to FIGS. 2, 3, 4 which illustrate further the various modes of operation of the present invention. FIG. 2 illustrates a pre-injection mode of operation. As a result of a prior metering mode of operation, as hereinafter described, a predetermined quantity of fuel resides within the metering chamber 74. The cam driven pumping piston 60 is illustrated moving downwardly under the force exerted by the cam 42 and the follower arm 40. In this pre-injection mode of operation, the control valve 130 is open so that fuel can escape from the timing chamber 72 and flow through the passage 38 out through the supply port 50 to the supply pump. During this pre-injection mode, the fill pressure regulator 132 closes passage 28 therein prohibiting additional fuel from flowing into the metering chamber 74.

FIG. 3 illustrates the injection mode of operation for the injector 10. In this mode of operation, the solenoid control valve 130 is closed. Upon the closure of the solenoid control valves 130, the fuel within the timing chamber 72 is trapped therein, thereby establishing a hydraulic link between the pumping piston 60 and the metering piston 70. The continued downward motion of the pumping piston forces the metering piston downward compressing the fuel within the metering chamber as well as compressing the fuel within passages 32 and 104. At a determinable pressure level, the pressure force of the fuel within passage 104 urges the needle valve upwardly against the bias force exerted by the spring 110 therein causing the needle valve 102 to move from its seat permitting fuel to flow from the flow orifices 106. The operation of the fuel injector 10 in its pre-injection and injection modes of operation is relatively identical to the modes of operation as discussed in U.S. Pat. No. 4,281,792 which has been incorporated by reference.

FIG. 4 illustrates the dumping mode of operation of the present invention wherein the pressure of the fuel within the timing chamber 72 and within the metering chamber 74 is relieved. During the dumping mode of operation, the control valve 130 remains closed and the fill pressure regulator 132 resides in a position to prohibit flow through passage 28. The dumping mode of operation terminates the fuel injection mode of operation by relieving the pressure of the fuel surrounding the needle valve 102, thus permitting the needle valve to rapidly close the flow path to the orifices 106. Just prior to the beginning of the dumping mode of operation, the pumping piston 60 operating through the hydraulic link established between the pumping piston and the metering piston has moved the metering piston into a position such that its upper edge 76 opens the timing chamber dump port 114. The opening of the dump port 114 permits the communication of the highly pressurized fuel from the timing chamber to be dumped through passages 24, bore 112 and orifice 122 to the drain therein substantially lessening the pressure of the fuel within the timing chamber 72. This dumping also disables the hydraulic link previously established linking the pumping piston 60 to the metering piston 70. The pressure in the metering chamber 74 is relieved as fuel continues to flow out from the nozzle 100. Due to inertia effects, this flow continues as the metering piston 70 moves further to increase the opening of the timing chamber dump port 114. As the needle valve 102 moves to terminate the nozzle flow, the metering piston 70 may move upward slightly further reducing the pressure in the metering chamber 74. During this process the pressure in the timing chamber 72 and the metering chamber 74 are substantially equal. As previously mentioned, the timing chamber 72 is dumped through the bore 112, that houses the spring 110 and through which a part of the needle valve 102 extends. By incorporating this single dump feature to dump the timing chamber fuel to the spring chamber 112 and through the orifice 122, the pressure within the spring chamber 112 is caused to build rapidly because of the flow restriction imposed by the orifice 122. This increase in the fuel pressure (which during non-dumping modes of operation is maintained at the low drain pressure) exerts a hydraulic force on that portion of the needle valve 102 extending into the spring chamber 112 therein exerting an additional biasing force upon the needle valve 102 to cause the needle valve 102 to rapidly close the flow orifices 106.

During the dumping mode of operation, that is as the fuel within the timing chamber is being dropped to a relatively low pressure, there may exist a pressure differential across the metering piston 70. It can be seen that after the timing chamber 72 has been dumped, its pressure will approach the pressure of the drain line which is substantially atmospheric pressure. However, the pressure within the metering chamber 74, that is the pressure exerted on the bottom face of the metering piston, is at a level determined by any residual injection pressure plus the supply pressure minus the pressure drop across the fill pressure regulator 132. This pressure differential causes the metering piston 70 to move upwardly, thus causing the metering piston 70 to momentarily move to a reference position that is above the bottom of the bore 90 and to thereupon close off the dump port 114. Depending upon the restrictions in the lines and their inherent line dynamics, during certain instances there may not be sufficient time for the pressure within the timing chamber 72 to be relieved to a sufficiently low level below that which is established by the fill pressure regulator 132. Consequently, it may be desirable to include within the profile of the cam 42, a dwell, which will cause the pumping piston 70 to remain at the bottom of its stroke for a determinable period during this dump mode of operation to permit the fuel within the timing chamber to continue to be dumped to drain. It can be seen that if the pumping piston 60 moves upwardly prematurely, that is while the timing chamber dump port 114 is still open, a vacuum pressure may be created within the timing chamber which will cause fuel to flow into the timing chamber rather than to be desirably removed therefrom. It should be noted by utilizing a single dump port 114 and by controlling the pressure differential across the metering piston 70 the timing chamber check valve shown in U.S. Pat. No. 4,281,792 is eliminated. In addition, to cause the metering piston 70 to achieve its reference position during the dwell mode and thereby close off the timing chamber dump port 114, it is necessary to create a pressure differential across the metering piston 70 during the dwell mode of operation. This is achieved by insuring that the pressure within the metering chamber is higher than that of the timing chamber during the dwell mode and therefore necessitates the dumping of the timing chamber to a low pressure drain such as a fuel tank reservoir.

The final mode of operation for the injector 10 is the metering mode which is illustrated in FIG. 1. This mode of operation is begun just after the metering piston 70 closes off the timing chamber dump port 114. During this mode of operation, the cam 42 causes the rocker arm to move upward. The spring 64 urges the follower 62 in an upward direction therein further moving the pumping piston 60. The motion of the pumping piston 60 creates a tendancy to lower the pressure within the timing chamber 72 and in cooperation with the positive pressure resident in the metering chamber causes the metering piston 70 to move upward. The metering piston 70 will substantially follow the motion of the pumping piston 60 until the control valve 130 is opened therein permitting fuel from the supply to enter the timing chamber, which thereafter creates a pressure nearly equal to the supply pressure in the timing chamber 72 which, combined with the pressure in the metering chamber 74 that is equal to the supply pressure reduced by the pressure drop across the pressure regulator 132, causes a net biasing force on the metering piston 70, terminating the upward motion of the meter piston. The metering chamber 74 is now charged with a determinable quantity of fuel and the operation of the injector continues again with the injector 10 entering its preinjection mode of operation as illustrated in FIG. 2.

Many changes in modifications in the above described embodiment of the invention can of course be carried out without departing from the scope thereof. Accordingly, that scope is intended to be limited only by the scope of the appended claims.

Having described the invention what is claimed is:

1. A fuel injector for an internal combustion engine comprising:

a body having an axially extending bore, a pumping piston and a remotely positioned metering piston positioned within said bore for axial movement therein; a timing chamber defined within said bore between the pumping piston and the metering piston and a metering chamber defined between the metering piston and the lower portion of the bore;

a first fuel passage having an electronically controlled valve situated therein for receiving pressurized fuel and for transmitting the fuel to the timing chamber and for establishing, when closed, a hydraulic link between said pumping piston and said metering piston;

a second fuel passage for receiving pressurized fuel and for transporting the received fuel to the metering chamber;

a pressure regulator situated in said second fuel passage for regulating the fuel pressure within said metering chamber at a predetermined level between the pressure level of said received pressurized fuel and the pressure level established in said timing chamber during the interval when said valve is closed and said pumping piston is retracting, said pressure regulator including means for preventing reverse fuel flow from the metering chamber to said second fuel passage;

a spring chamber situated remote from the metering chamber;

nozzle means situated remote from said metering chamber and partially extending into said spring chamber for selectively releasing fuel therefrom;

biasing means located within said spring chamber for biasing said nozzle means in a closed position during non-injecting modes of operation;

fuel passage means for providing a means for relieving pressure within the timing chamber thereby breaking said hydraulic link as said metering piston uncovers said fuel passage means as it is moved into said metering chamber under the influence of said pumping piston and for developing a hydraulic biasing force to further bias said nozzle means toward a closed condition to terminate the injection of fuel therefrom.

2. The fuel injector as defined in claim 1 wherein said fuel passage means includes a third fuel passage terminating at one end at the wall of said bore proximate said timing chamber therein forming in cooperation with said bore a timing chamber dump port, said third fuel passage also communicating with said spring chamber, said fuel passage means further including a fourth passage having a restrictive orifice situated therein for establishing upstream thereto an increased pressure during the period of time that fuel in the timing chamber is being dumped therethrough.

3. The fuel injector as defined in claim 2 wherein said timing chamber dump port is exposed after said metering piston has been moved downwardly by a determinable amount.

4. The fuel injector as defined in claim 3 further including motion stopping means for limiting the upward motion of said metering piston.

5. The fuel injector as defined in claim 4 wherein said motion stopping means includes a protrusion extending from said metering piston and a shoulder fabricated on said bore.

6. The fuel injector as defined in claim 2 wherein said pumping piston means includes a pumping piston joined to a cam by a rocker arm and wherein said cam includes a dwell profile to restrain the upward motion of said pumping piston for a determinable time during the dumping of fuel from said timing chamber and after said metering piston has initially uncovered said timing chamber dumping port to allow said metering piston to be moved upwardly by the pressure of the fuel within said metering chamber, as established by said pressure regulator to close off said timing chamber dump port.

7. The system as defined in claim 1 wherein said pressure regulator establishes a pressure within said metering chamber of sufficient magnitude to force said metering piston upward to terminate fluid communication through said timing chamber dump port.

* * * * *